United States Patent [19]

Tsuchiya

[11] Patent Number: 4,815,157

[45] Date of Patent: Mar. 28, 1989

[54] FLOOR CLEANER

[75] Inventor: Toshihiro Tsuchiya, Chiba, Japan

[73] Assignee: Kabushiki Kaisha Hoky, Chiba, Japan

[21] Appl. No.: 113,767

[22] Filed: Oct. 28, 1987

[30] Foreign Application Priority Data

Oct. 28, 1986 [JP] Japan ..... 61-165126[U]

[51] Int. Cl.[4] ..... A47L 11/32

[52] U.S. Cl. ..... 15/42; 15/342; 15/388

[58] Field of Search ..... 15/342, 41 R, 41 B, 15/42, 388, 41 A, 43

[56] References Cited

U.S. PATENT DOCUMENTS

| | | | |
|---|---|---|---|
| 2,994,098 | 8/1961 | Fukuba | 15/342 |
| 3,623,176 | 11/1971 | Leifheit et al. | 15/42 |
| 3,744,077 | 7/1973 | Smyth | 15/41 R |
| 3,748,679 | 7/1973 | Rosendall | 15/388 X |
| 4,099,284 | 7/1978 | Shinozaki et al. | 15/42 |
| 4,573,230 | 3/1986 | Saeki et al. | 15/41 R |
| 4,646,380 | 3/1987 | Kobayashi et al. | 15/41 R |

FOREIGN PATENT DOCUMENTS

| | | | |
|---|---|---|---|
| 51-46348 | 12/1976 | Japan . | |
| 56-34293 | 8/1981 | Japan . | |
| 1426686 | 3/1976 | United Kingdom | 15/364 |

*Primary Examiner*—Chris K. Moore

*Attorney, Agent, or Firm*—Wenderoth, Lind & Ponack

[57] ABSTRACT

A floor cleaner of the present invention has wheels provided on a main body casing which is journaled to a proximal portion of an operation handle, a rotary cleaning body on each side end portion of which is mounted a driven roller which is freely engageable by a respective one of the wheels, individual rotatable auxiliary rotary cleaning bodies located at both side end portions of the main body casing, respectively, and ducts communicating one of the dust collecting chambers, the chambers having dust intakes that respectively face the rotary cleaning body.

4 Claims, 4 Drawing Sheets

FLOOR CLEANER

FIELD OF THE INVENTION

This invention relates to a floor cleaner which sweeps particles of dust from a floor into dust collecting chambers by the rotation of a rotary cleaning body, and particularly to a floor cleaner which can clean the area near a wall or the like effectively.

DESCRIPTION OF THE RELATED ART

Heretofore, there has been proposed a floor cleaner which comprises a roll the outer circumference of which is provided with a plurality of either bristles (bristle type cleaner) or flexible elastic plates such as rubber plates, synthetic resin sheets or plates, metallic spring plates or the like (blade type cleaner), and which sweeps particles of dust from a floor when the above-described roll is rotated.

A floor cleaner of the type described above has, as shown in FIGS. 5 and 6, a rotary cleaning body 3 (which is either a bristle type or a blade type cleaner) which is rotatably journaled to the central portion of a main body casing 2 which in turn is journaled to a proximal portion of an operation handle 1, dust collecting chambers 4*a* and 4b located in the main body casing 2 with a dust intake 4*c* of the dust collecting chamber 4*a* and a dust intake 4*d* of the dust collecting 4*b* facing the rotary cleaning body 3, respectively. Furthermore, driven rollers 5, 5 are integrally mounted with the rotary cleaning body 3 on the same shaft at the opposite ends thereof, and a pair each of forward wheels 7*a*, 7*a* suspended from the main body casing 2 by swing arms 6*a*, 6*a* and rearward wheels 7*b*, 7*b* suspended from the main body casing 2 by swing arms 6*b*, 6*b*, respectively, are engageable with and releasable from the driven rollers 5, 5.

In the cleaner described above, the wheels 7*a*, 7*a* and 7*b*, 7*b* rotate in a prescribed direction during forward or rearward movement of the casing effected through the handle 1 of the floor cleaner, and at the same time one of the pairs of forward and rearward wheels (either the forward wheels 7*a*, 7*a* during forward movement, or the rearward wheels 7*b*, 7*b* during movement) swing through the swing arms 6*a*, 6*a* or the swing arms 6*b*, 6*b* to abut against or engage with the driven rollers 5, 5. As such forward or backward movement as described above continues, the rotation of the wheels 7*a*, 7*a* (or 7*b*, 7b) abutting the driven rollers 5, 5 is transmitted to the rotary cleaning body 3, and thus, the rotating rotary cleaning body 3 sweeps up particles of dust from a floor, whereby such particles are introduced into the dust collecting chambers 4*a* and 4*b* located in the main body casing 2.

In the conventional floor cleaner shown in FIGS. 5 and 6, however, since the driven rollers 5, 5 are mounted on the opposite end portions of the rotary cleaning body (brush) 3, the cleaner cannot sweep up particles of dust disposed on the floor under the driven rollers 5, 5, and, particularly, a disadvantage of the cleaner is that particles of dust disposed on the floor and near a wall cannot be swept up by only moving the floor cleaner forwardly and rearwardly.

On one hand, there has also been proposed a floor cleaner as shown in FIG. 7 in which auxiliary rotary brushes 8, 8 are mounted integrally with the respective driven rollers 5, 5 on the opposite end portions of rotary cleaning body 3 outside said driven rollers 5, 5, respectively, and particles of dust disposed on a floor at areas extending at the extreme opposite sides of a main body casing 2 are swept up under the rotation of the auxiliary rotary brushes 8, 8. In such a floor cleaner, however, there has also been a problem in that dust particles disposed under the driven rollers 5, 5 still cannot be swept up. Furthermore, an improved type of the above-described floor cleaner has been proposed in which a rotary cleaning body 3 as well as auxiliary rotary brushes 8, 8 are furnished with inclined bristles located on the respective sides of the opposite ends of both driven rollers 5, 5, respectively. However, comparing this floor cleaner to that shown in FIG. 7, the former is somewhat more effective than the latter, but most of the dust particles swept up by means of the inclined bristles of the rotary cleaning body 3 as well as the auxiliary rotary brushes 8, 8 are reflected by the driven rollers 5, 5 as well as the wheels 7*a*, 7*a* and 7*b*, 7*b*, respectively, and drop on the floor. Hence, this type of floor cleaner cannot solve the above-described problems completely.

OBJECT AND SUMMARY OF THE INVENTION

The present invention has been made in view of the disadvantages of the prior art described above, and its object is to positively sweep up particles of dust from a floor that are disposed under both side end portions of a main body casing so as to be able to easily clean an area near a wall.

To achieve this object, the present invention provides a floor cleaner of the type wherein a rotary cleaning body is rotatably journaled to a main body casing which in turn is journaled to a proximal portion of an operation handle, dust collecting chambers have dust intakes that face said rotary cleaning body, respectively, wheels are mounted on said main body casing, and driven rollers which are freely engageable with said wheels, respectively, are integrally mounted with said rotary cleaning body on the opposite ends thereof, and characterized in that individual rotatable auxiliary rotary cleaning bodies are located at both the side end portions of said main body casing, respectively, and ducts communicating with a dust collecting chamber respectively face said auxiliary rotary cleaning bodies.

BRIEF DESCRIPTION OF THE DRAWINGS

FIGS. 1–4 illustrate a preferred embodiment of the floor cleaner of the present invention wherein FIG. 1 is a partially broken away side view of the floor cleaner, FIG. 2 is a bottom view of a longitudinal half of the floor cleaner, FIG. 3 is a perspective view of an essential part of the floor cleaner, and FIG. 4 is a sectional view of the part shown in FIG. 3; and FIGS. 5–7 illustrate a conventional floor cleaner wherein FIG. 5 is a partially broken away side view, FIG. 6 is a bottom view, and FIG. 7 is a bottom view of an essential part of another conventional floor cleaner.

DETAILED DESCRIPTION OF THE PREFERRED EMBODIMENT

Figure 1:
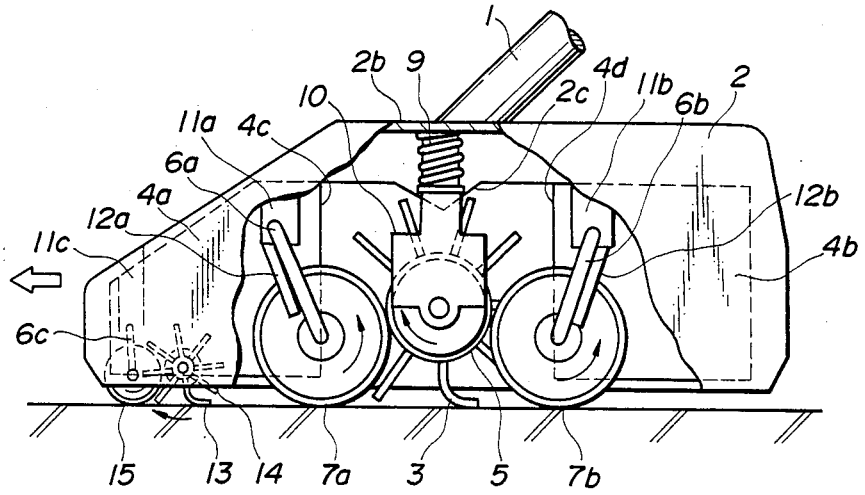
Figure 2:
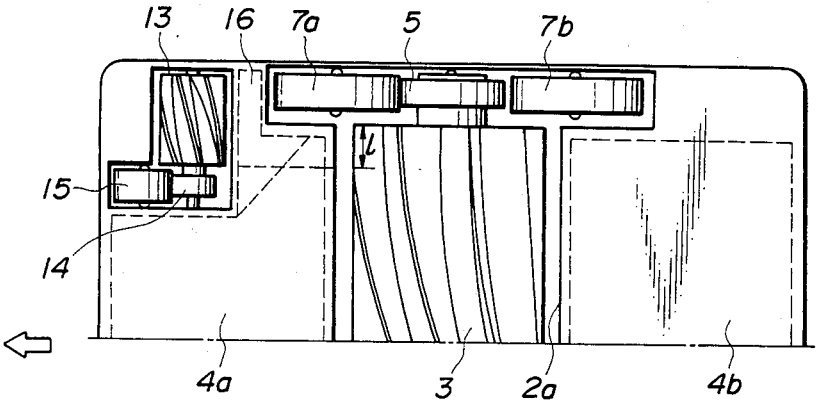

A preferred embodiment of the floor cleaner according to the present invention will be described in detail hereinbelow by referring to FIGS. 1–4 wherein an operation handle 1 to be pushed by a user is rotatably journaled on the top of a main body casing 2, an opening 2a for accommodating a rotary cleaning body 3 is defined on the bottom of said casing 2, and dust collecting chambers 4*a* and 4*b* each having a prescribed volume are located inside both forward and rearward portions of the main body casing 2. The rotary cleaning body 3 is fabricated by providing the outer circumference of a roll with a plurality of spiral blades for sweeping up particles of dust from a floor. Driven rollers 5, 5 are integrally mounted with the rotary cleaning body 3 on the same shaft, and an end surface of each of the driven rollers 5, 5 is rotatably journaled to a bracket 10 suspended from the top **2*b* of the main body casing 2 through a spring 9 so that the rotary cleaning body 3 is disposed in the opening 2*a* of the main body casing 2. A dust intake 4*c* of the dust collecting chamber 4*a* and a dust intake 4*d* of the dust collecting chamber 4*b* face the rotary cleaning body 3 attached to the main body casing 2, respectively. An inner top wall 2*c* having a substantially V-shaped profile is disposed in the opening 2*a* of the main body casing 2, and portions of the top wall extending in both forward and rearward directions in the cleaner are contiguous with the dust intake 4*c* of the dust collecting chamber 4*a* and the dust intake 4*d* of the dust collecting chamber 4*b***.

Wheels **7*a* and 7*b* are disposed both forwardly and rearwardly of each of said driven rollers 5, 5. The wheel 7*a* and the wheel 7*b* are rotatably attached to one end of a swing arm 6*a* and a swing arm 6*b*, respectively, each of which comprises an iron bar having an ]-shaped profile. The other end of each of the swing arms 6*a*, 6*a* is rotatably suspended from brackets 11*a*, 11*a*, respectively, which are supported by and fixed to the main body casing 2, while the other end of each of the swing arms 6*b*, 6*b* is also rotatably suspended from brackets 11*b*, 11*b*, respectively, which are also supported by and fixed to the main body casing 2, whereby a pair each of the swing arms 6*a*, 6*a* and 6*b*, 6*b* are freely swingable in forward and rearward directions, respectively. The range over which these swing arms 6*a*, 6*a* as well as the swing arms 6*b*, 6*b* are swingable is limited by stoppers 12*a*, 12*a* extending from the brackets 11*a*, 11*a* and stoppers 12*b*, 12*b* extending from the brackets 11*b*, 11*b*. These members are arranged in such a manner that each of the forward wheels 7*a*, 7*a* swing rearwardly during forward movement of the floor cleaner to abut and engage with each of the driven rollers 5, 5 while each of the rearward wheels 7*b*, 7*b* swing forwardly during rearward movement of the cleaner to abut and engage with each of the driven rollers 5, 5**.

Furthermore, auxiliary rotary cleaning bodies 13, 13 are disposed in the front part of the main body casing 2 at the opposite corners thereof. The auxiliary rotary cleaning body 13 is similar to the rotary cleaning body 3 in that the outer circumference of a roll is provided with a plurality of spiral blades, and a driven roller 14 is integrally mounted with the auxiliary rotary cleaning body 13 on the same shaft. The driven roller 14 mounted integrally and coaxially with the auxiliary rotary cleaning body 13 is rotatably journaled to the main body casing 2, and an auxiliary wheel 15 is suspended from brackets **11*c*, 11*c*supported by and fixed to the main body casing 2 through swing arms 6c, 6c, which are similar to said forward and rearward swing arms 6*a*, 6*a* as well as 6*b*, 6*b*, in front of each of the driven rollers 14. Thus, the auxiliary wheel 15 swings backwardly via the swing arm 6*c* during forward movement of the floor cleaner to abut and engage with the driven roller 14 thereby rotating the auxiliary rotary cleaning body 13. It is to be noted that each of the auxiliary rotary cleaning bodies 13, 13 is overlapped with respect to the roll brush (rotary cleaning body) 3 over a predetermined width as taken widthwise of the main body casing 2. Furthermore, the swingable range of the swing arms 6*c*, 6*c* is restricted by stoppers (not shown) as with each pair of the swing arms 6*a*, 6*a* and 6*b*, 6*b* suspending the wheels 7*a*, 7*a* and 7*b*, 7*b***, respectively.

Figure 3:
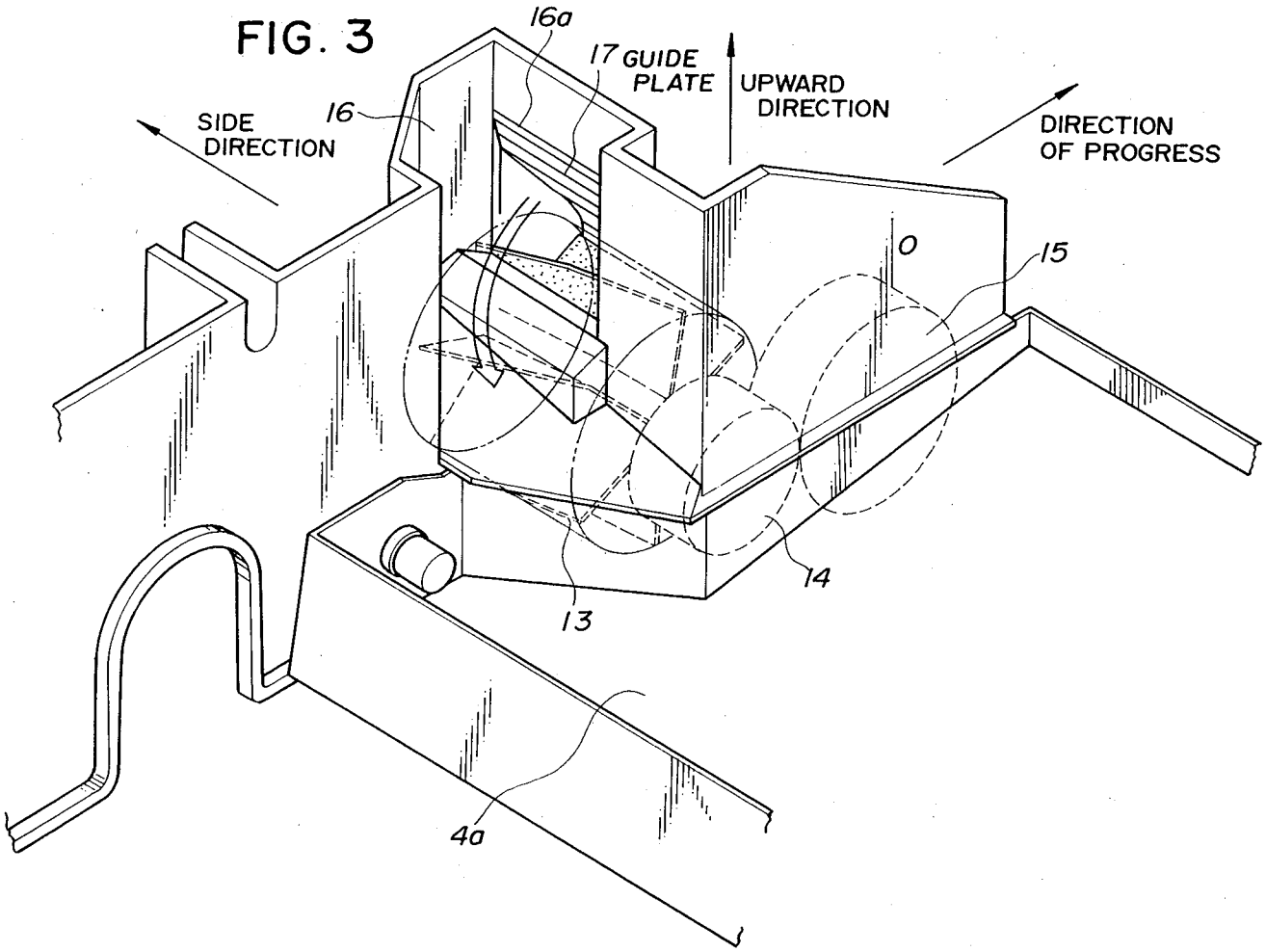
Figure 4:
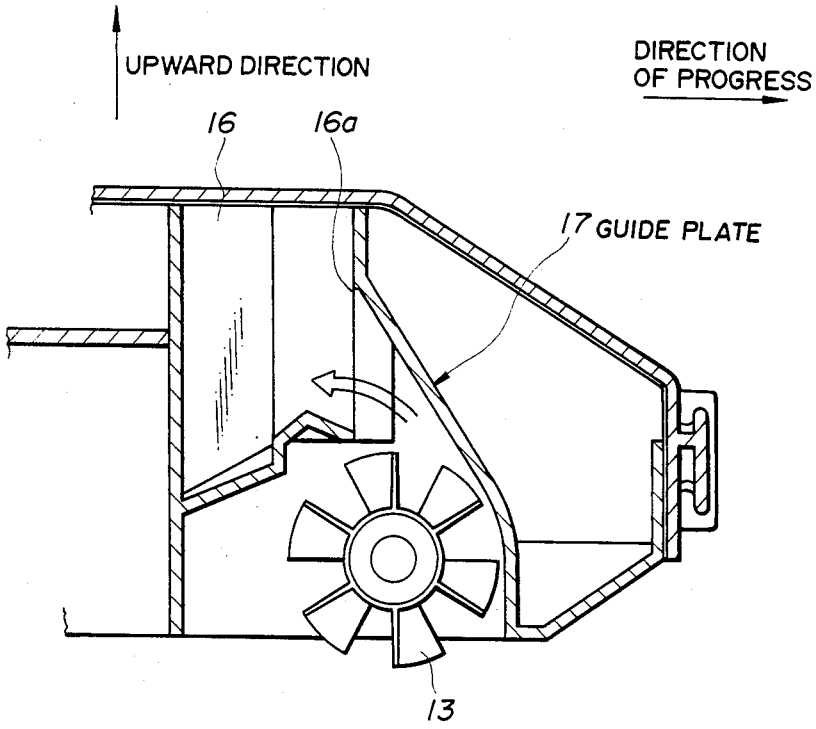
Figure 5:
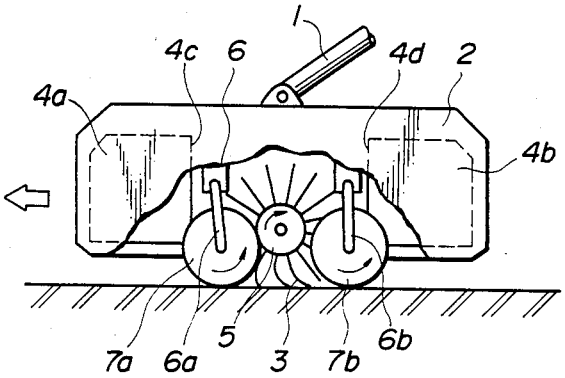
Figure 6:
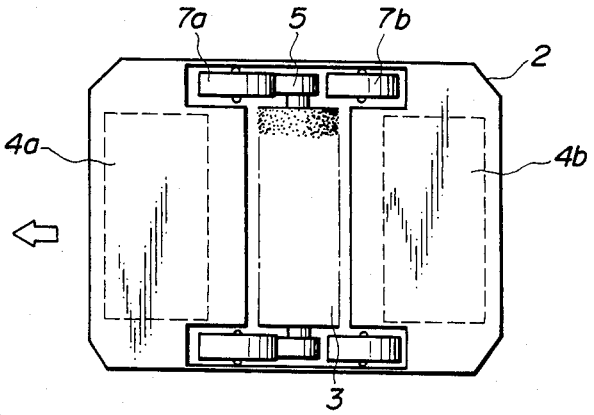
Figure 7:
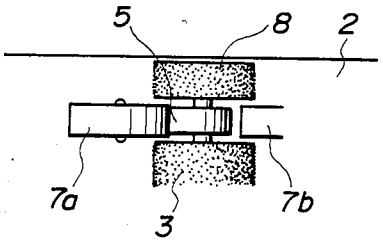

As shown in FIGS. 3 and 4, an opening **16*a* of a duct 16 communicating with the forward dust collecting chamber 4*a* faces the upper portion of each of the auxiliary rotary cleaning bodies 13, 13, and a guide plate 17 extends from the front of each of the auxiliary rotary cleaning bodies 13, 13 to each of the openings 16*a*, 16*a* of the ducts 16, 16 situated above each of the auxiliary rotary cleaning bodies 13, 13, whereby particles of dust which have been swept up from a floor by means of each of the auxiliary rotary cleaning bodies 13, 13 are guided by each of the guide plates 17, 17 to be introduced in each of the ducts 16, 16**.

When it is desired to sweep particles of dust from a floor by the use of the floor cleaner according to the present invention, first, a user grips an extreme end of the handle 1 to push the floor cleaner forwardly or rearwardly. During forward movement, the forward wheels **7*a*, 7*a* swing rearwardly through the swing arms 6*a*, 6*a* to abut the driven rollers 5, 5, while the rearward wheels 7*b*, 7*b* swing rearwardly and rotate on the swing arms 6*b*, 6*b* abutting the stoppers 12*b*, 12*b*. When the forward wheels 7*a*, 7*a* abut the driven rollers 5, 5, the rotation of the wheels 7*a*, 7*a* is transmitted through each of the driven rollers 5, 5 to rotate the rotary cleaning body 3 in the direction of the arrows in FIG. 1. As the floor cleaner according to the present invention is further pushed forwardly, the blades of the rotary cleaning body 3 continuing rotating while contacting the floor to sweep up dust particles from the floor, and the dust particles thus swept up are introduced into the dust intake 4*c* of the dust collecting chamber 4*a* and the dust intake 4*d* of the dust collecting chamber 4*b* directly or after rebounding from the top wall 2*c*. When the floor cleaner is pushed backwards, the forward wheels 7*a*, 7*a* swing forwardly over a predetermined amount through the swing arms 6*a*, 6*a* limited by the stoppers 12*a*, 12*a*, while the rearward wheels 7*b*, 7*b* swing forwardly through the swing arms 6*b*, 6*b* to abut the driven rollers 5, 5. And, the rearward wheels 7*b*, 7*b* rotate the rotary cleaning body 3 in the direction reverse to that in which the cleaning body 3 rotates during forward movement. Thus, particles of dust on the floor are introduced into the dust intake 4*c* of the dust collecting chambers 4*a* and the dust intake 4*d* of the dust collecting 4*b*. Furthermore, since the driven rollers 5, 5 abutting either the wheels 7*a*, 7*a* or the wheels 7*b*, 7*b* are suspended from the top 2*b* of the main body casing 2 through the springs 9, 9, the contact force is kept constant by damper action effected by the spring 9, 9, whereby a smooth rotation of the rotary cleaning body 3** is always attained.

In either case when the floor cleaner advances or retreats, the auxiliary wheels 15, 15 provided on the opposite corners in the forward portion of the main body casing 2 rotate synchronously with the movement of the cleaner. During the forward movement, the auxiliary wheels 15, 15 swing backwardly through the swing arms 6c, 6c to abut the driven rollers 14, 14 respectively, while the auxiliary wheels 15, 15 swing forwardly through the swing arms 6c, 6c during backward movement, and the auxiliary wheels 15, 15 continue rotating with the swing arms 6c, 6c abutting the stoppers (not shown). Accordingly, the rotation of the auxiliary wheels 15, 15 is transmitted to the driven rollers 14, 14 only during forward movement to rotate each of the auxiliary rotary cleaning bodies 13, 13 in the direction of the arrow in FIG. 4. And, when the auxiliary rotary cleaning bodies 13, 13 rotate, the particles of dust on a floor which lie under both the side end portions of the main body casing 2 are swept up, by means of the blades of the auxiliary rotary cleaning bodies, into each of the dust intakes 16*a*, 16*a* of the ducts 16, 16 via each of the guide plates 17, 17 and these dust particles are introduced into the duct collecting chamber 4*a* through each of the ducts 16, 16.

Accordingly, the floor cleaner of the present invention can sweep up substantially all of the particles of dust from a floor, by repeatedly moving forwardly and rearwardly and particularly, in the vicinity of a wall. The rotary cleaning body 3 cooperates with the auxiliary rotary cleaning bodies 13, 13 to sweep up dust particles across the entire width of the main body casing 2, so that complete cleaning is performed without leaving any particles of dust.

As described above, in accordance with the present invention, there is provided a floor cleaner of the type wherein a rotary cleaning body is rotatably journaled to a main body casing which is journaled to a proximal portion of an operation handle, dust collecting chambers have dust intakes that face said rotary cleaning body, respectively, wheels are mounted on said main body casing, and driven rollers which are freely engageable by said wheels, respectively, are integrally mounted with said rotary cleaning body on the opposite ends thereof, and characterized in that individual rotatable auxiliary rotary cleaning bodies are located at both the side end portions of said main body casing, respectively, and ducts communicating with each of said duct collecting chambers respectively face auxiliary rotary cleaning bodies.

According to the above-described floor cleaner of the present invention, particles of dust on a floor which are positioned under the driven rollers are swept up so that a perfect cleaning operation across the entire main body casing is facilitated, and the present floor cleaner can be used particularly effectively for cleaning the area near a wall.

What is claimed is:

1. A floor cleaner for sweeping up dust from a floor, said cleaner comprising:

a main casing having a front portion, a rear portion, and opposite sides extending from said front to said rear portions;

a handle to which said main casing is rotatably mounted;

a rotary cleaning body rotatably mounted to said main casing and disposed therein between said front and said rear portions, dust collecting chambers defined at the front and the rear portions of said casing, respectively, each of said dust collecting chamber having an opening confronting said rotary cleaning body;

driven rollers disposed adjacent the opposite sides of said casing at opposite end portions of said rotary cleaning body, respectively, said driven rollers integral with said rotary cleaning body so as to rotate therewith;

rotatable drive wheels mounted to said casing and disposed at the opposite sides of said casing adjacent said driven rollers for supporting said casing on a floor, said drive wheels engageable with said driven rollers for rotating said driven rollers; and individual auxiliary rotary cleaning bodies disposed adjacent the opposite sides of said casing at said front portion thereof, respectively, for sweeping up dust from a floor which lies under said main casing adjacent said sides thereof when the cleaner is moved over the floor, and said main casing having ducts extending therein which are open between a respective one of said auxiliary cleaning bodies and the dust collecting chamber at the front portion of said casing.

2. A cleaner as claimed in claim 1, wherein said main casing comprises a front wall at said front portion thereof, the opposite sides of said casing intersect said front wall to define respective front corners of said casing, and said auxiliary cleaning bodies are rotatably mounted to said casing and disposed therein at said front corners thereof, and further comprising an auxiliary driven roller integral with each of said auxiliary cleaning bodies and disposed inwardly thereof with respect to said main casing, and auxiliary wheels mounted to said casing and freely engageable with each said auxiliary driven roller, respectively, for rotating each said auxiliary roller.

3. A floor cleaner as claimed in claim 2, wherein said auxiliary bodies each have inner portions extending inwardly of the opposite end portions of said rotary cleaning body, respectively, in said casing in a direction extending between the opposite sides of said casing.

4. A floor cleaner as claimed in claim 1, wherein said auxiliary bodies each have inner portions extending inwardly of the opposite end portions of said rotary cleaning body, respectively, in said casing in a direction extending between the opposite sides of said casing.

* * * * *